US006871513B2

(12) United States Patent
Guillard

(10) Patent No.: US 6,871,513 B2
(45) Date of Patent: Mar. 29, 2005

(54) PROCESS AND INSTALLATION FOR SEPARATION OF AIR BY CRYOGENIC DISTILLATION INTEGRATED WITH AN ASSOCIATED PROCESS

(75) Inventor: Alain Guillard, Paris (FR)

(73) Assignee: L'Air Liquide, Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 10 days.

(21) Appl. No.: 10/415,835

(22) PCT Filed: Oct. 29, 2001

(86) PCT No.: PCT/IB01/02016

§ 371 (c)(1),
(2), (4) Date: Apr. 30, 2003

(87) PCT Pub. No.: WO02/37042

PCT Pub. Date: May 10, 2002

(65) Prior Publication Data

US 2004/0069016 A1 Apr. 15, 2004

(30) Foreign Application Priority Data

Oct. 30, 2000 (EP) ..... 00203754

(51) Int. Cl.[7] ..... F25J 3/00
(52) U.S. Cl. ..... 62/648; 62/644; 60/784
(58) Field of Search ..... 62/617, 640, 643, 62/644, 648; 60/39.181, 784

(56) References Cited

U.S. PATENT DOCUMENTS

| | | | | |
|---|---|---|---|---|
| 4,343,156 A | | 8/1982 | Gauthier | |
| 5,291,737 A | | 3/1994 | Camberlein et al. | |
| 5,329,776 A | | 7/1994 | Grenier | |
| 5,341,647 A | | 8/1994 | Koeberle et al. | |
| 5,907,959 A | * | 6/1999 | Agrawal et al. | 62/646 |
| 6,141,950 A | * | 11/2000 | Smith et al. | 60/783 |

FOREIGN PATENT DOCUMENTS

| | | |
|---|---|---|
| EP | 0 504 029 A1 | 9/1992 |
| EP | 0 531 182 A1 | 3/1993 |
| EP | 0 538 118 A1 | 4/1993 |
| EP | 0 562 893 A1 | 9/1993 |
| EP | 0 583 189 A1 | 2/1994 |
| EP | 0 748 763 A1 | 12/1996 |
| FR | 2 477 276 A1 | 9/1981 |
| FR | 2 688 052 A1 | 9/1993 |

* cited by examiner

*Primary Examiner*—William C. Doerrler
(74) *Attorney, Agent, or Firm*—Linda K. Russell

(57) ABSTRACT

In a process for separation of air by cryogenic distillation integrated with an associated process, air is separated in a separation unit (1), fluid is sent from the separation unit to an associated process, steam (3) is derived from the associated process, at least part of the steam is used in the separation unit and at least one fluid stream (11) is sent from the air separation unit to the atmosphere, at least when the steam is used in the air separation unit.

33 Claims, 2 Drawing Sheets

PROCESS AND INSTALLATION FOR SEPARATION OF AIR BY CRYOGENIC DISTILLATION INTEGRATED WITH AN ASSOCIATED PROCESS

The present invention relates to a process and installation for separation of air by cryogenic distillation, integrated with an associated process.

Air separation units are frequently integrated with associated processes producing large amounts of water vapour, such as gas-to-liquid (GTL) and gas-to-olefins (GTO) processes. On remote sites where the vapour cannot be used to generate energy and the vapour cannot be exported, the excess vapour, representing between 5 and 30% of the steam production, is generally sent to a condenser where it is converted into water, as described in EP-A-0748763.

The air separation units generally supply oxygen enriched gas at a pressure exceeding 5 bar abs. to the associated process.

One object of the present invention is to reduce the size of the steam condenser or even eliminate it completely, thereby reducing the capital costs of the plant.

It is known from 'The Future of Air Separation', a conference given by Dr. T. Rathbone at LTEC90, held in 1990, to couple a steam turbine using steam from a partial oxidation system with the compressor of an air separation unit.

EP-A-0562893 describes an air separation unit in which the air compressor and nitrogen compressor are powered by a steam turbine. According to the present invention, there is provided a process for separation of air by cryogenic distillation integrated with an associated process comprising the steps of:

a) cooling compressed and purified air to a cryogenic temperature in a heat exchanger by heat exchange with fluids separated in an air separation unit b) separating compressed, purified and cooled air in an air separation unit to produce at least one fluid enriched in oxygen and/or at least one fluid enriched in nitrogen and possibly at least one fluid enriched in argon, c) sending at least part of one said fluid to an associated process, d) deriving at least one stream of steam from the associated process, e)using at least part of the steam in the air separation unit, characterised in that it comprises operating the air separation unit with at least one of the following process features:

i) operating the heat exchanger to have a temperature difference between a warm stream entering the heat exchanger and a stream leaving the heat exchanger, having been warmed, of at least 5 K, preferably at least 10 K, at its warm end and/or ii) producing the fluid enriched in oxygen with a yield of less than 95%, preferably less than 90% and/or iii) sending at least first and second fluid streams from the air separation unit to the atmosphere and/or iv) warming a fluid stream separated in the air separation unit against a stream of steam wherein in the case where features i), ii) and/or iii) are used, and optionally in the case where feature iv) is used, at least one steam turbine is used to produce work and the work is used to supply at least part of the energy needs of at least one main compressor compressing air treated in the air separation unit and/or an air booster compressing air which has already been compressed to a superatmospheric pressure and/or a compressor for gas enriched in oxygen or nitrogen.

In this way, the air separation unit functions in a way which is deliberately chosen to be less than optimal for example by oversizing the air separation unit, in order to use the steam in the air separation unit and avoid using a steam condenser or reduce the size of the condenser, so as to reduce the overall costs for the whole of the site including the air separation unit. Certainly energy is wasted by operating the air separation unit in this way but the overall cost of the wastage is reduced.

In one embodiment of the invention, the process comprises sending energy to the atmosphere by sending at least first and second fluid streams from the air separation unit to the atmosphere.

Preferably the first fluid stream sent to the atmosphere is previously used to regenerate the purification unit used to purify the air and the second fluid stream or streams sent to the atmosphere is air and/or is/are enriched in oxygen, nitrogen and/or argon and is preferably at a pressure of at least 5 bar abs.

The second fluid stream or streams is/are preferably warmed to ambient temperature in a heat exchanger and then sent directly to the atmosphere, possibly after an expansion step.

Alternatively or additionally, the second fluid stream or streams is compressed air, removed before or after purification, preferably at a pressure of at least 5 bar abs.

In a preferred embodiment, the column operating at the lowest pressure of the air separation unit (other than an argon column) is operating at least 2 bar abs., preferably 4 bar abs.

Preferably, at least two air separation units supply fluid to the associated process, each air separation unit being dimensioned to produce N/N-1 multiplied by at least 80%, preferably 90% or even 100%, of the nominal flow, N being the number of air separation units supplying the associated process.

Preferably the process comprises expanding at least part of the vapour in at least one turbine coupled to at least one compressor of the air separation unit Preferably, at least one steam turbine is used to produce work and the work is used to supply at least part of the energy needs of at least one main compressor compressing air treated in the air separation unit and/or an air booster compressing air which has already been compressed to a superatmospheric pressure and/or a compressor for gas enriched in oxygen or nitrogen.

For example, the at least one turbine may be coupled to a main compressor compressing air treated in the air separation unit and/or to an air booster compressing air which has already been compressed to a superatmospheric pressure and/or to a compressor for gas enriched in oxygen or nitrogen.

Alternatively the steam turbine may be used to generate electricity and that electricity may be used to power at least one of the compressors of the air separation unit.

According to another embodiment of the process, the process comprises sending energy to the atmosphere by sending refrigeration from the air separation unit to the atmosphere.

For example, vapour from the associated process may be sent to at least one heat exchanger forming part of the air separation unit, at least one cryogenic liquid produced in the air separation unit is sent to the at least one heat exchanger, at least one cryogenic liquid vaporises at least partially in the heat exchanger and is sent to the atmosphere and/or to an associated process in gaseous form.

Alternatively, vapour from the associated process is sent to at least one heat exchanger of the air separation unit, at least one cryogenic fluid produced in the air separation unit is sent to the at least one heat exchanger wherein it is warmed and the warmed cryogenic fluid is then expanded in a turbine before being sent to the atmosphere.

At least one fluid stream, other than that used for regeneration, is sent to the atmosphere from the air separation unit constantly or when the amount of steam derived from the associated process exceeds a given value.

This fluid stream may represent at least 1% of the air separated in the air separation unit, preferably at least 5%.

It may be an oxygen-enriched fluid, a nitrogen enriched fluid or air.

Preferably the fluid stream is warmed in the heat exchanger and then sent directly to the atmosphere, without undergoing transformation.

In a particular embodiment, the fluid sent to the associated process is an oxygen rich gas and the associated process is a partial oxidation process associated with a catalytic conversion process producing excess steam.

Preferably the at least one fluid stream is not used or is only partly used to regenerate a unit used to remove humidity and carbon dioxide from the feed air for the air separation unit or an air separation unit and is not used or is only partly used in a water chilling unit.

Preferably, steam is sent constantly or substantially constantly to the air separation unit.

According to another embodiment of the invention, there is provided an installation for separation of air by cryogenic distillation integrated with an associated process including:

i) at least one air compressor for compressing air to be treated in an air separation unit ii) an air separation unit comprising a purification unit, heat exchangers, and at least one cryogenic distillation column iii) means for supplying compressed air from the main air compressor to the air separation unit iv) means for removing a fluid enriched in a component of air from the air separation unit and sending it to an associated process v) means for transferring steam from the associated process to the air separation unit and vi) means for sending at least one fluid stream from the air separation unit to the atmosphere, without previously sending the fluid stream to regenerate an air purification unit.

The means for sending at least one fluid stream from the air separation unit to the atmosphere may be connected to the main air compressor and/or to a column of the air separation unit.

Preferably the installation comprises a steam turbine coupled to the main air compressor and/or an air booster of the air separation unit and/or a gaseous product compressor of the air separation unit and means for feeding at least part of the steam from the associated process to the steam turbine.

According to a further embodiment, the invention comprises an installation for separation of air by cryogenic distillation integrated with an associated process including:

i) at least one air compressor for compressing air to be treated in an air separation unit ii) an air separation unit comprising a purification unit, heat exchangers, and at least one cryogenic distillation column iii) means for supplying compressed air from the main air compressor to the air separation unit iv) means for removing a fluid enriched in a component of air from the air separation unit and sending it to an associated process v) means for transferring steam from the associated process to the air separation unit, vi) a heat exchanger, vii) means for sending at least part of the steam from the associated process to the heat exchanger and viii) means for sending a cryogenic fluid from a column of the air separation unit to the heat exchanger to be warmed by indirect heat exchange with the steam, said heat exchanger being connected to the means for sending at least one fluid stream from the air separation unit to the atmosphere and/or to the associated process. In one embodiment, the installation comprises means for expanding the fluid stream downstream of the heat exchanger, for example a turbine.

Preferably the cryogenic fluid is a liquid, supplied from the air separation unit and, possibly, from at least one other air separation unit and the cryogenic liquid is stored in a tank before being sent to the heat exchanger. The tank (and possibly the pump, if the liquid is pressurised) may be common to the air separation unit and another air separation unit or to all the air separation units.

Thus the air separation unit is voluntarily operated so as to waste energy, either in the form of one of the product gases or a compressed air stream by sending it to the atmosphere or in the form of refrigeration. This in fact proves to be more economical for the overall cost of the plant than the present techniques for disposing of the excess steam, which are costly in terms of equipment and maintenance.

An oxygen enriched stream contains at least 30 mol. % oxygen, preferably at least 60 mol. % oxygen and still more preferably at least 80 mol. % oxygen.

An argon enriched stream contains at least 30 mol. % argon, preferably at least 60 mol. % argon and still more preferably at least 80 mol. % argon.

A nitrogen enriched stream contains at least 85 mol. % nitrogen, preferably at least 90 mol. % nitrogen and still more preferably at least 95 mol. % nitrogen.

The air stream released to the atmosphere is at a pressure of at least 5 bar abs. preferably at least 10 bar abs. or at least 20 bar abs or at least 30 bar abs.

The oxygen enriched stream and/or nitrogen enriched stream released to the atmosphere is/are at a pressure of at least 10 bar abs. or preferably at least 20 bar abs or at least 30 bar abs.

It will be understood that the term 'air separation unit' may include the main air compressors(s), booster compressor(s), product compressor(s), product storage tanks or buffer tanks, heat exchangers, distillation columns, pump(s) and turbine(s). The term thus may cover elements within and without the cold box.

An air separation unit may include a single column, a double column (for example as described in FR-A-2477276, EP-A-0504029, FR-A-2688052 or EP-A0583189) or a triple column (for example as described in EP-A-0538118) and possibly additionally at least one argon enrichment column and/or a mixing column (for example as described in EP-A-0531182).

The associated process may be any process consuming a fluid produced by the air separation unit, such as an oxygen enriched stream and/or an argon enriched stream and/or a nitrogen enriched stream and/or compressed air and which produces steam either directly from the stage of the process consuming the enriched stream or another stage of the process upstream or downstream that stage.

The term "treated in the air separation unit" covers separation by cryogenic distillation within the unit but also covers the case where a stream is simply compressed by the main air compressor of the unit or by another process upstream of the columns.

The 'nominal' flow of the air separation unit is the maximum real product flow to the customer for which it is designed.

It will of course be understood that the gaseous stream may be sent to the atmosphere either by sending them into the air, for example using a device such as claimed in French Patent Application 2000-13382, or by sending them into a tank of water or a bed of solid material.

The invention will now be described in further detail with reference to the figures.

Figure 1:
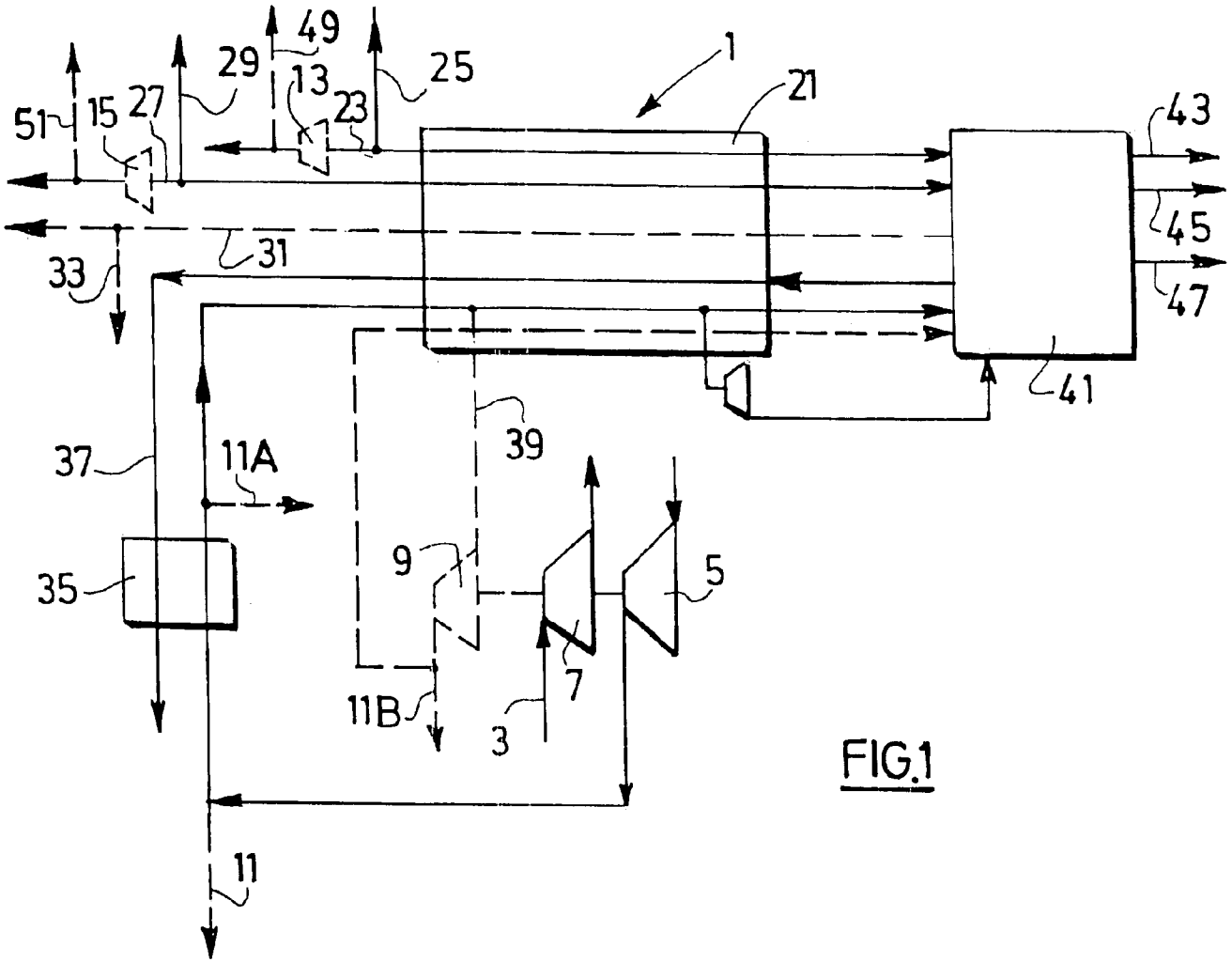
FIG. 1 is a schematic drawing of an air separation unit and a GTL process integrated to function according to the process of the invention, with at least one compressor of the air separation unit being coupled to a steam turbine.

In FIG. 1, natural gas is sent to a partial oxidation process using oxygen from an air separation unit 1 to produce a synthesis gas containing carbon monoxide and hydrogen. The synthesis gas is reacted catalytically to produce higher molecular weight hydrocarbon products and excess steam 3.

The air separation unit may be of any known type and may comprise a classical double column or a triple column. The air to be treated is first compressed in at least one main air compressor 5, which is coupled to a steam turbine 7 in which the excess steam 3 is expanded. The main air compressor or compressors preferably compress the feed air to between 5 and 35 bar abs. Part of the air may then be compressed in a booster compressor 9, which is also coupled to the or a steam turbine. The Figure shows the compressor 9 as a cold booster but it may of course have an inlet temperature equal to or higher than the ambient temperature.

The air is sent to the air separation unit wherein it is separated to form at least a waste nitrogen stream 37 containing at least 90 mol. % nitrogen, a nitrogen enriched gaseous product stream 27 containing between 90 and 99.99 mol. % nitrogen (optional), a product argon stream 31 containing between 90 and 99,99 mol. % argon (optional), an oxygen enriched liquid stream 43 (optional), a nitrogen enriched liquid stream 45 (optional) and an oxygen enriched gaseous stream 23 containing between 70 and 99,8 mol. % oxygen with a yield of less than 95%, preferably less than 90%. Preferably the nitrogen and argon streams each contain less than 1 ppm oxygen. The waste nitrogen stream 37 only is used to regenerate the purification unit 35 of the air separation process. The heat exchanger 21 used to cool the air to a cryogenic temperature against product streams 23,27,31 is operated to have a temperature difference of at least 5 K, preferably 10K between the temperature of the entering air and at least one of the product streams coming from the warm end.

The product nitrogen and oxygen streams in gaseous form may be removed from the column system in gaseous form or may be removed in liquid form from the column system and optionally pressurised in a pump (not shown).

It will be appreciated that, given the demands of the partial oxidation process, there are commonly several air separation units used to provide the oxygen requirements and connected in parallel, for example four air separation units, each having their own main air compressor or compressors.

There may be a common air network for the compressed air linking the compressors of several air separation units. Similarly, there may be an oxygen network linking the oxygen outputs of several air separation units.

If the amount of air compressed in the main air compressor or compressors is such that the amount of oxygen produced would be surplus to the requirements of the partial oxidation process, various solutions are possible according to the invention.

Firstly, the excess compressed air can be sent to the atmosphere in a stream 11 upstream of the purification unit 35 and/or a stream 11A downstream the purification unit and/or a stream 11B removed following further compression in booster 9. In all cases the pressure of the air 11,11A,11B exceeds 5 bar abs. and may exceed 15 bar abs.

In this case the columns of the air separation unit are dimensioned to produce the maximum amount of oxygen required by the partial oxidation process and no streams are sent to the atmosphere except the air stream or streams 11,11A,11B and the stream 37 used for the regeneration.

Alternatively or additionally, the columns of the air separation unit can be dimensioned to receive the excess compressed air and a stream enriched in oxygen 25, nitrogen 29 or argon 33 can be released to the atmosphere, since the amount of products produced exceeds the requirements of the partial oxidation process.

It will of course readily be seen that the excess air can be released to the atmosphere following distillation in the form of different streams having different compositions. Air may additionally be sent to the atmosphere in the form of streams 11,11A,11B.

In the case of the figure, the streams form part of the normal product streams but it will readily be seen that the streams sent to the atmosphere may have a purity greater than or less than the product stream purity. For example, in the case where excess steam is available, a stream of oxygen enriched gas less pure than stream 23 may be sent to the atmosphere.

Should the partial oxidation process require additional oxygen, the oxygen can be supplied by no longer rejecting the oxygen stream 25 to the atmosphere or by reducing the oxygen enriched stream 25.

During start-up, the steam turbine 7 is driven by steam produced by a boiler fuelled by natural gas.

A or the steam turbine may additionally or alternatively be coupled to a compressor 13 for the oxygen enriched gas 23 or a compressor 15 for the nitrogen enriched gas 27, as shown in dashed lines.

Figure 2:
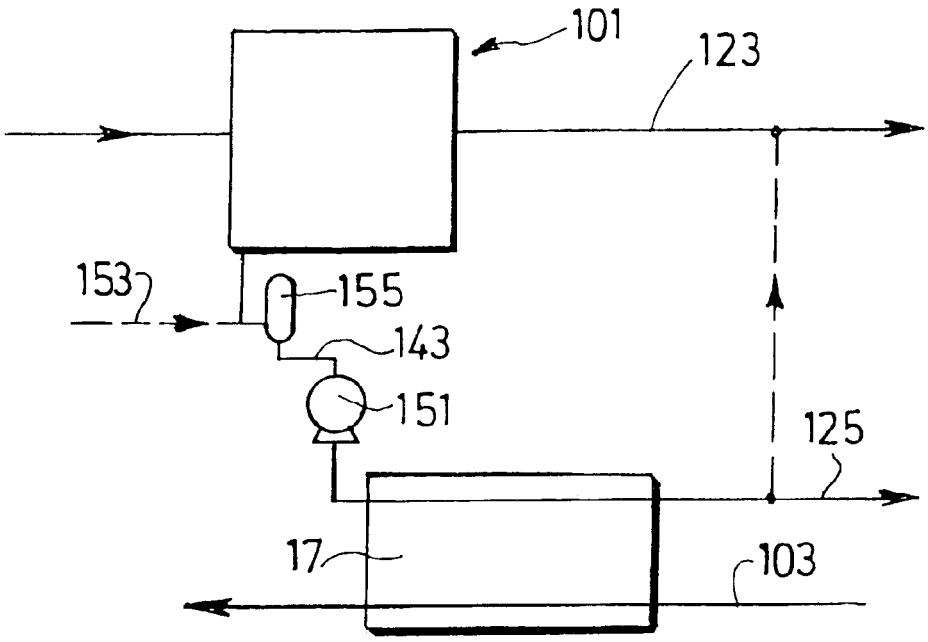
FIG. 2 is a schematic drawing of an air separation unit and a GTL process integrated to function according to the process of the invention, with a heat exchanger in which steam is used to vaporise a cryogenic liquid of the air separation unit.

In FIG. 2, natural gas is sent to a partial oxidation process using oxygen from an air separation unit 101 to produce a synthesis gas containing carbon monoxide and hydrogen. The synthesis gas is reacted catalytically to produce higher molecular weight hydrocarbon products and excess steam 103.

The air separation unit may be of any known type and may comprise a classical double column or a triple column as described in the patents mentioned above. The air to be treated is first compressed in a main air compressor, which may or may not be coupled to a steam turbine in which part of the excess steam is expanded, as in FIG. 1. Alternatively in the case of FIG. 2, there need be no steam expansion step. The main air compressor preferably compresses the feed air to between 5 and 35 bar abs. Part of the air may then be compressed in a booster compressor between 10 and 70 bar abs., which could also be coupled to the steam turbine.

The air separation unit produces at least a gaseous oxygen enriched stream 123 and a liquid oxygen enriched stream 143.

When excess steam is available from the conversion process, a stream 103 comprising all or part of the excess steam is sent to a heat exchanger 17 outside or inside the cold box where it exchanges heat with a stream of oxygen enriched liquid 143 and/or nitrogen enriched liquid and/or argon enriched liquid, so as to vaporise at least partially the liquid and form a gaseous stream, at least part 125 of which may be released to the atmosphere.

The liquid may previously have been stored in a storage tank 155 and/or pressurised in a pump 151 inside or outside the air separation unit 101 before vaporisation. Additionally or alternatively liquid 153 of the same of similar composition may be supplied from another air separation unit or from a storage tank common to several of the air separation units or all the air separation units or from a tanker truck.

In FIG. 2, the steam is used to vaporise only a stream containing between 60 and 99,8 mol. % oxygen 143 and the gaseous stream 125 formed is released to the atmosphere.

Should the partial oxidation process require additional oxygen, the oxygen can be supplied by no longer rejecting the oxygen enriched stream 125 to the atmosphere or by reducing the oxygen enriched stream released to the atmosphere, as shown in dashed lines on the figure.

If the excess vapour is no longer available, the liquid stream is no longer sent from the air separation unit to the exchanger and the air separation unit produces the liquid stream 143 as a final product. Obviously if the amount of excess vapour is simply reduced, a smaller amount of cryogenic liquid 143 may be sent from the air separation unit to the heat exchanger and the rest of the liquid constitutes a small production of liquid.

Alternatively all the gas vaporised in the heat exchanger 17 may be sent to the associated process. In this case it is not the gaseous product which is wasted but refrigeration, since it is a source of irreversibility to produce the product in liquid form only to vaporise it subsequently to form a gaseous product. In this case, the loss of energy is in the form of refrigeration, which may be sent to the atmosphere or transferred to the vapour stream.

A further object of the invention is a process for separation of air by cryogenic distillation comprising the steps of separating compressed and purified air in an air separation unit to produce at least one fluid enriched in oxygen and at least one fluid enriched in nitrogen and possibly at least one fluid enriched in argon, characterised in that it comprises sending a gas stream containing at least 35 mol. % oxygen and/or at least 5 mol. % argon to the atmosphere.

Preferably the stream sent to the atmosphere includes at least 60 mol. % oxygen, or even at least 80 mol. % oxygen.

Preferably the stream sent to the atmosphere is not used or is only partly used to regenerate the purification system of the air separation unit.

In the case where one of the air separation units is not in operation, it becomes possible to supply all the oxygen required, by vaporising stored liquid oxygen in the heat exchanger 17 of FIG. 2, which of course can be used even if the column system is not operating.

Figure 3:
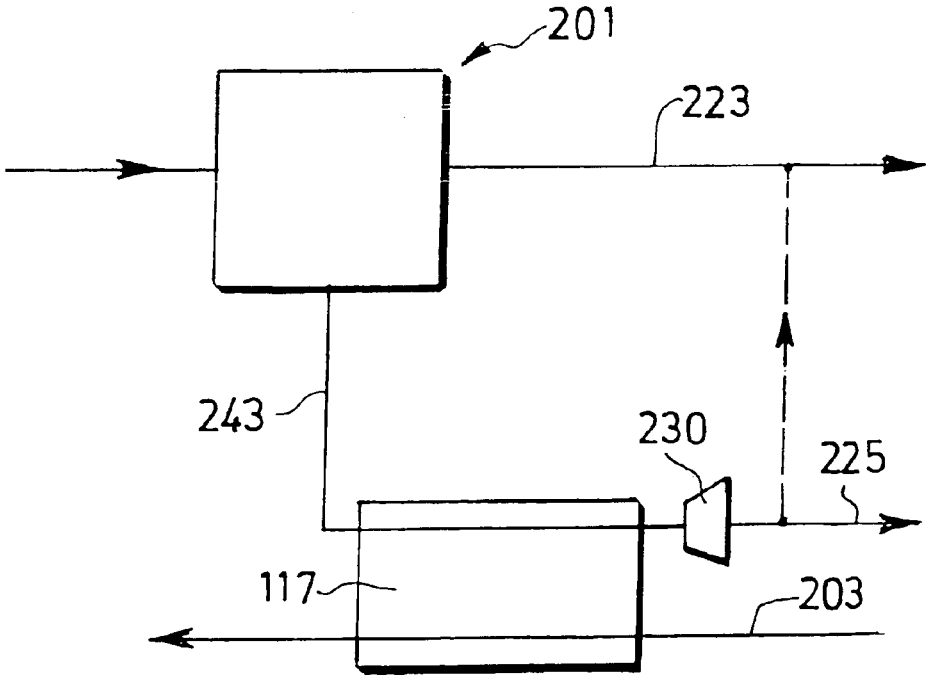
FIG. 3 is a schematic drawing of an air separation unit and a GTL process integrated to function according to the process of the invention, with a heat exchanger in which steam is used to warm a cryogenic fluid of the air separation unit, before the fluid is expanded in a turbine.

In the system of FIG. 3, a fluid stream 243 in liquid or gaseous form is removed from the air separation unit 201 and sent to heat exchanger 117 where it vaporises in the case of a liquid or is warmed in the case of gas by indirect heat exchange with the stream of excess steam 203. The gaseous stream produced 225 is expanded in a turbine 230 and is sent to the atmosphere and/or to the associated process.

Whilst the processes of the Figures all use integration of the air separation unit with a GTL process, it will be readily apparent that this kind of integration may be used with any process, fed by the air separation unit with compressed air or a fluid separated in the air separation unit, from which steam may be derived such as a gas turbine.

What is claimed is:

1. A process for separation of air by cryogenic distillation integrated with an associated process comprising the steps of a) cooling compressed and purified air to a cryogenic temperature in a heat exchanger by heat exchange with fluids separated in an air separation unit, b) separating compressed, purified and cooled air in an air separation unit to produce at least one fluid enriched in oxygen and/or at least one fluid enriched in nitrogen, c) sending at least part of one said fluid to an associated process, d) deriving at least one stream of steam from the associated process, e) operating the air separation unit to use at least part of said steam from said associated process, wherein said operating comprises a stream of steam; and f) producing work with at least one steam turbine, wherein said work is used to supply at least part of the energy needs of at least one member selected from the group consisting of:

i) at least one main compressor compressing air treated in the air separation unit;

ii) an air booster compressing air which has already been compressed to a superatmospheric pressure; and iii) a compressor for gas enriched in oxygen or nitrogen.

2. The process of claim 1, wherein step b) also comprises at least one fluid enriched in argon.

3. The process of claim 1, wherein the heat exchanger operates normally with a temperature difference between a warm stream entering the heat exchanger and a stream leaving the heat exchanger of at least about 10 K.

4. The process of claim 1, wherein producing the fluid enriched in oxygen with a yield of less than 90%.

5. The process of claim 1, further comprising sending at least first and second fluid streams from the air separation unit to the atmosphere wherein the first fluid stream sent to the atmosphere is previously used to regenerate the purification unit used to purify the air and the second fluid stream or streams sent to the atmosphere is/are enriched in oxygen and/or nitrogen.

6. The process of claim 5, wherein the second fluid stream or streams is/are additionally enriched in argon.

7. The process of claim 5, further comprising a pressure of at least about 5 bar abs.

8. The process of claim 1, further comprising sending at least first and second fluid streams from the air separation unit to the atmosphere wherein the second fluid stream or streams is compressed air, removed before or after purification.

9. The process of claim 8, wherein the compressed air is at a pressure of at least about 5 bar abs.

10. The process of claim 1, wherein at least two air separation units supply fluid to the associated process, each air separation unit being dimensioned to produce N/N-1 multiplied by at least about 80% of the nominal flow, N being the number of air separation units supplying the associated process.

11. The process of claim 10, wherein each air separation unit being dimensioned to produce N/N-1 multiplied by at least about 90% or even about 100%.

12. The process of claim 1, further composing expanding at least part of the vapour in at least one turbine coupled to at least one compressor of the air separation unit.

13. The process of claim 1, wherein at least one steam turbine is coupled to at least one main compressor compressing air treated in the air separation unit and/or to an air booster compressing air which has already been compressed to a superatmospheric pressure and/or to a compressor for gas enriched in oxygen or nitrogen.

14. The process of claim 1, further comprising warming a fluid stream separated in the air separation unit against a stream of steam wherein vapour from the associated process is sent to at least one heat exchanger forming part of the air separation unit, at least one cryogenic liquid produced in the air separation unit is sent to the at least one heat exchanger, the at least one cryogenic liquid vaporises at least partially in the heat exchanger and is sent to the atmosphere and/or to an associated process in gaseous form.

15. The process of claim 1, further comprising warming a fluid stream separated in the air separation unit against a stream of steam wherein vapour from the associated process is sent to at least one heat exchanger of the air separation unit, at least one cryogenic fluid produced in the air separation unit is sent to the at least one heat exchanger wherein it is warmed and the warmed cryogenic fluid is then expanded in a turbine before being sent to the atmosphere.

16. The process of claim 1, wherein at least one fluid stream is sent to the atmosphere from the air separation unit constantly or wherein at least one second fluid stream is sent to the atmosphere from the air separation unit substantially constantly.

17. The process of claim 16, wherein the at least one fluid stream is an oxygen enriched gaseous stream.

18. The process of claim 1, wherein at least one fluid stream is sent to the atmosphere from the air separation unit when the amount of steam derived from the associated process exceeds a given value or wherein at least one second fluid stream is sent to the atmosphere from the air separation unit when the amount of steam derived from the associated process exceeds a given value.

19. The process of claim 18, wherein the at least one fluid stream is an oxygen enriched gaseous stream.

20. The process of claim 1, wherein the fluid sent to the associated process is an oxygen rich gas and the associated process is a partial oxidation process associated with a catalytic conversion process producing excess steam.

21. The process of claim 1, wherein the at least one fluid stream is not used or is only partly used to regenerate a unit used to remove humidity and carbon dioxide from the feed air for the air separation unit or another air separation unit and is not used or is only partly used in a water chilling unit.

22. The process of claim 1, wherein a fluid sent from the air separation unit to the associated process and a fluid sent from the air separation unit to the atmosphere have the same principal component, the fluid sent to the associated process being less pure or purer than the fluid sent to the atmosphere.

23. The process of claim 1, wherein steam is sent constantly or substantially constantly to the air separation unit.

24. An installation of air by cryogenic distillation integrated with an associated process including:

i) at least one air compressor for compressing air to be treated in an air separation unit, ii) an air separation unit comprising a purification unit, at least one heat exchanger, and at least one cryogenic distillation column, iii) means for supplying compressed air from the main air compressor to the air separation unit, iv) means for removing a fluid enriched in a component of air from the air separation unit and sending it to an associated process, v) means for transferring steam from the associated process to the air separation unit, and vi) means for sending at least one fluid stream from the air separation unit to the atmosphere, without previously sending the fluid stream to regenerate the air purification unit.

25. The installation of claim 24, wherein the means for sending at least one fluid stream from the air separation unit to the atmosphere is connected to the main air compressor.

26. The installation of claim 24, wherein the means for sending at least one fluid stream from the air separation unit to the atmosphere is connected to a column of the air separation unit.

27. The installation of claim 24, further comprising at least one steam turbine producing work and means to use the work for the energy needs of the main air compressor and/or an air booster of the air separation unit and/or a gaseous product compressor of the air separation unit and means for feeding at least part of the steam from the associated process to the steam turbine(s).

28. An installation for separation of air by cryogenic distillation integrated with an associated process including:

i) at least one air compressor for compressing air to be treated in an air separation unit, ii) an air separation unit comprising a purification unit, at least one heat exchanger, and at least one cryogenic distillation column, iii) means for supplying compressed air from the main air compressor to the air separation unit, iv) means for removing a fluid enriched in a component of air from the air separation unit and sending it to an associated process, v) means for transferring steam from the associated process to the air separation unit, vi) means for sending at least part of the steam from the associated process to the heat exchanger, and vii) means for sending a cryogenic fluid from a column of the air separation unit to the heat exchanger to be warmed by indirect heat exchange with the steam, said heat exchanger being connected to the means for sending at least one fluid stream from the air separation unit to the atmosphere and/or to the associated process.

29. The installation of claim 28, further comprising means for expanding the fluid stream downstream of the heat exchanger.

30. The installation of claim 28, wherein the cryogenic fluid is a liquid, supplied from the air separation unit and wherein the cryogenic liquid is stored in a tank before being sent to the heat exchanger.

31. The installation of claim 30, wherein the cryogenic fluid is additionally supplied from at least one other air separation unit.

32. The process of claim 1, further comprising performing said process in the absence of a steam condenser.

33. The process of claim 1, wherein said warming of said fluid stream against said stream of steam minimizes the need for a steam condenser.

* * * * *

UNITED STATES PATENT AND TRADEMARK OFFICE

CERTIFICATE OF CORRECTION

PATENT NO. : 6,871,513 B2
DATED : March 29, 2005
INVENTOR(S) : Alain Guillard

It is certified that error appears in the above-identified patent and that said Letters Patent is hereby corrected as shown below:

Column 8,
Line 22, insert -- warming a fluid steam separated in the air separation unit against -- between the word "comprises" and the phrase "a stream of steam".

Column 9,
Line 4, replace the word "composing" with the word -- comprising --.
Line 61, insert -- for separation -- between the word "installation" and the word "of".

Signed and Sealed this

Sixth Day of December, 2005

JON W. DUDAS
*Director of the United States Patent and Trademark Office*